US005392970A

United States Patent [19]

Orosei

[11] Patent Number: 5,392,970

[45] Date of Patent: Feb. 28, 1995

[54] DEVICE FOR TURNING HOSIERY ITEMS INSIDE OUT WITH HIGH OPERATING RELIABILITY

[75] Inventor: Mario Orosei, Reggio Emilia, Italy

[73] Assignee: Conti Complett S.p.A., Milan, Italy

[21] Appl. No.: 200,331

[22] Filed: Feb. 23, 1994

[30] Foreign Application Priority Data

Mar. 30, 1993 [IT] Italy ..... MI93A000621

[51] Int. Cl.[6] ..... A41H 43/00

[52] U.S. Cl. ..... 223/39; 223/42; 223/41

[58] Field of Search ..... 223/39, 40, 41, 42, 223/43

[56] References Cited

U.S. PATENT DOCUMENTS

| | | | |
|---|---|---|---|
| 2,702,544 | 2/1955 | Harrington | 223/40 |
| 3,310,207 | 3/1967 | Gore | 223/39 |
| 4,460,111 | 7/1984 | Nakahira | 223/43 |
| 4,509,666 | 4/1985 | Rosso | 223/42 |
| 4,694,978 | 9/1987 | Westphal et al. . | |
| 5,106,000 | 4/1992 | Small et al. | 223/39 |

FOREIGN PATENT DOCUMENTS

| | | | |
|---|---|---|---|
| 2545114 | 4/1976 | Germany . | |
| 2103257 | 2/1983 | United Kingdom | 223/39 |
| 2164964 | 4/1986 | United Kingdom . | |
| 639981 | 2/1979 | U.S.S.R. | 223/39 |

*Primary Examiner*—Clifford D. Crowder
*Assistant Examiner*—Bibhu Mohanty
*Attorney, Agent, or Firm*—Guido Modiano; Albert Josif; Daniel O'Byrne

[57] ABSTRACT

Device for turning hosiery items inside out including elements for gripping a hosiery item and moving it along an advancement direction so that the top of the hosiery item is orientated in the advancement direction, and opening elements that engage the hosiery item and act transversely to the advancement direction to open the top of the hosiery item. The device furthermore includes elements for turning the hosiery item inside out that comprise a first component that can be inserted in the hosiery item through the open top, until it reaches proximate to the toe, and has, starting from its end meant to be inserted in the hosiery item, a cavity for the insertion of a second rod-like component which can engage the toe of the hosiery item arranged at the end of the first component. The second component can be inserted in the first component in the direction opposite to the direction of insertion of the first component in the hosiery item, turning the hosiery item inside out along the second component. There are also elements for removing the inside-out hosiery item from the second component.

8 Claims, 4 Drawing Sheets

DEVICE FOR TURNING HOSIERY ITEMS INSIDE OUT WITH HIGH OPERATING RELIABILITY

BACKGROUND OF THE INVENTION

The present invention relates to a device for turning hosiery items, typically socks and stockings, inside out with high operating reliability.

As it is known, hosiery items are generally manufactured by forming a tubular item that is open at its two opposite ends and by subsequently closing one of these two ends, which constitutes the toe of the hosiery item, by stitching or darning.

Since the toe of the hosiery item must be closed while said hosiery item is turned inside out, it is necessary to turn said hosiery item inside out prior to its packaging.

Among the various devices currently used to turn hosiery items inside out, a device is known which comprises a pair of rollers with parallel axes that are rotated about the respective axes in opposite directions. The two rollers can move mutually closer or further apart so that the hosiery item to be turned inside out is placed between them; the hosiery item is placed between the two rollers so that its toe protrudes from the side of the region of mutual contact of the rollers that lies in the direction of the tangential speed in the mutual contact region.

On the side toward which the toe of the hosiery item protrudes, this known device has a rod which is arranged in the plane tangent to both rollers and can move longitudinally to engage the toe of the hosiery item and advance between the two rollers in the direction opposite to that of their peripheral speed in the region of mutual contact, so that the combined action of the advancement of the rod and of the rotation of the rollers turns the hosiery item inside out along the rod.

These devices furthermore generally have a pair of counter-rotating secondary rollers that are arranged adjacent to the two main rollers, on the side opposite to the rod insertion side, and rotate in reverse with respect to said two main rollers so as to engage the hosiery item, which is inside out on the rod, when it is at the end of its advancement, and remove it from the rod while the rod is moved backward to its initial position.

In other kinds of devices, substantially based on the same operating concept, the two rollers are replaced with two mutually facing belts that are meant to receive, between them, the hosiery item and the rod which has engaged the toe thereof. The two belts are actuated, as regards their portion which is in contact with the hosiery item, with speeds orientated in the same direction and opposite to the direction along which the rod is inserted between the belts, so as to equally turn the hosiery item inside out along the rod.

Although these kinds of devices can achieve high productivity, they have the problem that they are not reliable enough in turning inside out small hosiery items, such as for example those meant for children.

Furthermore, these devices can damage hosiery items made of delicate thread, since the rollers or belts rub and press on the hosiery item while turning it inside out.

SUMMARY OF THE INVENTION

The aim of the present invention is to solve the problems described above by providing a device for turning hosiery items inside out that is highly reliable in operation, regardless of the size of the hosiery items to be turned inside out.

Within the scope of this aim, an object of the invention is to provide a device that can turn hosiery items inside out without causing damage even in the case of hosiery items made of delicate, i.e. low-strength, thread.

Another object of the invention is to provide a device that has high productivity and can fully meet the requirements of modern hosiery manufacturing plants.

A further object of the invention is to provide a device which has competitive production costs with respect to the production costs of known devices for turning hosiery items inside out.

With this aim and these objects in view, there is provided, according to the present invention, a device for turning hosiery items inside out, characterized in that it comprises: means for gripping a hosiery item and moving it along an advancement direction so that the top of the hosiery item is orientated in the advancement direction; opening means that engage the hosiery item and act transversely to said advancement direction to open said top; means for turning the hosiery item inside out that comprise a first component that can be inserted in the hosiery item with one of its ends through said open top until it reaches proximate to the toe and forms, starting from said end, a cavity for the insertion of a second rod-like component which can engage the toe of the hosiery item arranged at said end of the first component and can be inserted in said cavity through said end of the first component, in the direction opposite to the direction of insertion of said first component in the hosiery item, turning said hosiery item inside out along said second component; and means for removing the inside-out hosiery item from said second component.

BRIEF DESCRIPTION OF THE DRAWINGS

Further characteristics and advantages of the device according to the invention will become apparent from the following detailed description of a preferred but not exclusive embodiment thereof, illustrated only by way of non-limitative example in the accompanying drawings, wherein.

DESCRIPTION OF THE PREFERRED EMBODIMENTS

Figure 1:
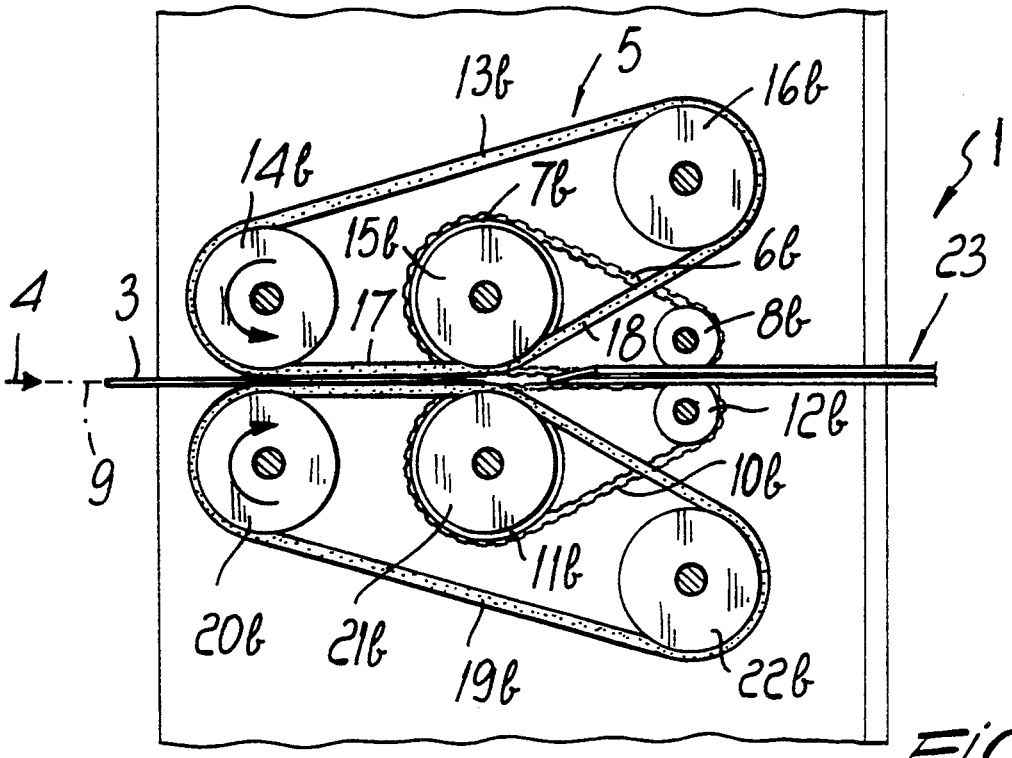
FIG. 1 is a schematic sectional lateral elevation view of the device according to the invention, taken along the vertical median plane I—I shown in FIG. 4.
Figure 2:
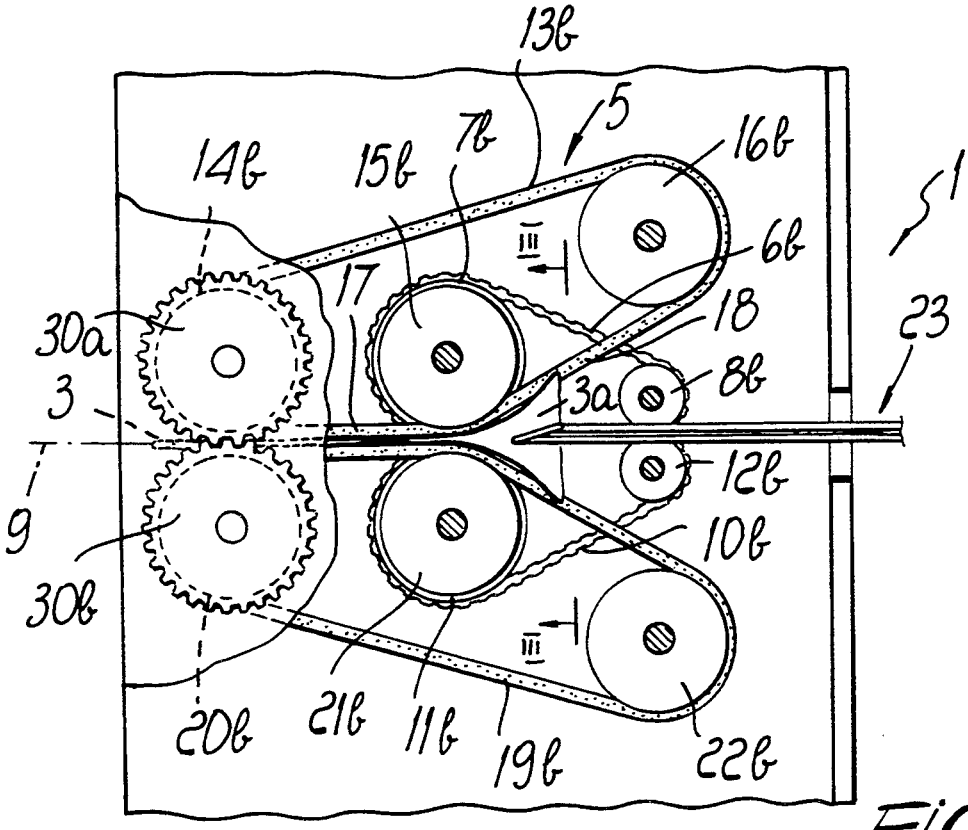
FIG. 2 is a schematic view, similar to FIG. 1, of the device according to the invention during the insertion of the first component of the reversing means inside a hosiery item.

With reference to the above figures, the device according to the invention, generally designated by the reference numeral 1, comprises means 2 for gripping a hosiery item 3 to be turned inside out and for moving it along an advancement direction 4 with the top 3*a* of the hosiery item 3 directed in the advancement direction, and opening means 5 that engage the hosiery item 3 and act transversely to the advancement direction 4 to open the top 3*a* of the hosiery item 3, as will become apparent hereinafter.

More particularly, the grip and advancement means 2 comprise at least two pairs of belts; a first pair 6*a* and 6*b* winds around pulleys 7*a*, 8*a* and 7*b*, 8*b* respectively and a second pair of belts 10*a* and 10*b*; the pulleys 7*a* and 7*b* are mutually coaxial, and the pulleys 8*a* and 8*b* have the same axis and are spaced in a forward direction from the pulleys 7*a* and 7*b* along the advancement direction 4 of the hosiery item. The pulleys 7*a*, 7*b* and 8*a*, 8*b* are arranged so that a portion of the belts 6*a* and 6*b* that is stretched between the associated pulleys is substantially co-planar to the corresponding portion of the other belt and is tangent, together with it, to an ideal plane 9 that constitutes the plane of arrangement of the hosiery item 3 during its movement along the advancement direction 4.

The pulleys 7*a* and 8*a* are spaced from the pulleys 7*b* and 8*b* transversely to the advancement direction 4 so as to engage proximate to the edges of the hosiery item 3, which is flattened and arranged parallel to the advancement direction 4.

The second pair of belts 10*a* and 10*b* of the grip and advancement means 2 is arranged symmetrically with respect to the belts 6*a* and 6*b* of the first pair relative to the ideal plane 9 and winds around pulleys 11*a*, 12*a* and 11*b*, 12*b* that are equally arranged symmetrically with respect to the pulleys 7*a*, 8*a* and 7*b*, 8*b* relative to said plane 9.

In practice, the portions of the belts 6*a*, 6*b*, stretched between the pulleys 7*a*, 8*a* and 7*b*, 8*b* that face the plane 9, engage one side of the flattened hosiery item arranged on said plane 9, whereas the portions of the belts 10*a* and 10*b*, stretched between the pulleys 11*a*, 12*a* and 11*b*, 12*b* that face the other side of the plane 9, engage the other side of the hosiery item 3.

The opening means 5 comprise grip means that can engage two opposite sides of the flattened hosiery item 3 and can move apart on opposite sides with respect to the plane of arrangement 9 of the flattened hosiery item 3 in order to open the top 3*a* of the hosiery item 3.

The opening means preferably comprise at least two pairs of belts: a first one, 13*a* and 13*b*, winds around pulleys 14*a*, 15*a* and 16*a* and around pulleys 14*b*, 15*b* and 16*b*; and a second pair of belts 19*a* and 19*b*.

The pulleys 14*a* and 14*b* are arranged mutually coaxially upstream of the pulleys 7*a* and 7*b* along the advancement direction 4 of the hosiery item 3, and their common axis is transverse to said advancement direction 4. The pulleys 15*a* and 15*b* are arranged coaxially to the pulleys 7*a* and 7*b* and between them, whereas the pulleys 16*a* and 16*b* are mutually coaxial and arranged downstream of the pulleys 15*a* and 15*b* along the advancement direction 4, and their common axis is spaced from the plane of arrangement 9 by more than the distance between the axis of the pulleys 15*a* and 15*b* and said plane of arrangement 9. The pulleys 14*a*, 14*b*, 15*a*, 15*b* and 16*a*, 16*b*, the axes of which are mutually parallel, are arranged between the belts 6*a* and 6*b*. The pulleys 14*a*, 14*b*, 15*a*, 15*b* and 16*a*, 16*b* are furthermore arranged so as to make the belts 13*a* and 13*b* follow a path of which a first part 17 is substantially tangent to the plane of arrangement 9 and a second part 18 moves progressively away from said plane of arrangement 9 along the advancement direction 4. Furthermore, the distance between the pulleys 14*a* and 14*b* transversely to the advancement direction 4 is greater than the distance between the pulleys 15*a* and 15*b*, which are very close to each other, and the distance between the pulleys 16*a* and 16*b* is again greater than the distance between the pulleys 15*a* and 15*b*.

In this manner, the belts 13*a* and 13*b* progressively approach each other along the first part 17 and then move mutually apart along the second part 18.

The second pair of belts 19*a* and 19*b* of the opening means is symmetrical to the pair of belts 13*a* and 13*b* with respect to the plane of arrangement 9. In the same manner, the belts 19*a* and 19*b* of the second pair wind around pulleys 20*a*, 20*b*, 21*a*, 21*b* and 22*a*, 22*b* which are substantially identical to the pulleys 14*a*, 14*b*, 15*a*, 15*b* and 16*a*, 16*b* and are arranged symmetrically to them with respect to the plane of arrangement 9.

The pulleys 14*a* and 14*b* are actuated in a per se known manner so that they rotate about their common axis and are connected, for example by means of a pair of gears 30*a* and 30*b* with a unit gear ratio, to the pulleys 20*a* and 20*b* so as to make the portions of the various belts which are tangent to the plane 9 advance along the direction 4. The connection provided by these belts and the fact that the pulleys 15*a* and 15*b* rotate about the common axis rigidly with the pulleys 7*a* and 7*b*, as also the pulleys 21*a* and 21*b* rotate rigidly with the pulleys 11*a* and 11*b*, ensure transmission of the rotary motion to the various pulleys around which the belts wind.

The device according to the invention furthermore comprises means 23 for turning the hosiery item 3 inside out which are constituted by a first component 24 and by a second rod-like component 25.

More particularly, the first component is substantially constituted by two rods 26*a* and 26*b* which are associated with an annular body 27 at one of their longitudinal ends; said annular body forms, within the first component 24 and together with the rods 26*a* and 26*b*, a cavity 28 which is open starting from the end of the first component 24 where the annular body 27 is located; the second component 25 can be inserted in said cavity 28, as will become apparent hereinafter.

Advantageously, the annular body 27 has a substantially elliptical shape with two mutually diametrically opposite straight segments 27*a* and 27*b* joined by two curved segments 28*a* and 28*b*. The ends of the rods 26*a* and 26*b* are pivoted to the two segments 28*a* and 28*b* of the annular body 27 about a pivoting axis that is substantially at right angles to said rods 26*a* and 26*b*, so that a longitudinal translatory motion of the rod 26*a* with respect to the rod 26*b*, or vice versa, moves the annular body 27 from a position substantially co-planar to the two rods 26*a* and 26*b*, which are close to each other, to a position in which the annular body 27 lies on a plane substantially at right angles to the two rods 26*a* and 26*b*, which are mutually parallel and spaced from one another.

The first component 24 can be positioned, by virtue of known movement means not shown for the sake of simplicity, parallel to the advancement direction 4 between the belts of the opening means at the end of the first part 17 and so that its end that supports the annular body 27 is directed opposite to the advancement direction 4 of the hosiery item.

The second component 25 is simply constituted by a rod having such dimensions that it can be inserted loosely in the first component 23 through the annular body 27. Insertion of the second component 25 through the annular body 27 can be performed by virtue of known movement means, not shown for the sake of simplicity.

The device according to the invention furthermore comprises means for removing the hosiery item 3 from the second component 25. Said spacing means may be simply constituted by a pair of rollers 29*a* and 29*b* that rotate in opposite directions and laterally touch, on opposite sides, the second component 25 with a peripheral speed, at the region of contact with the second component 25, that is directed towards the end of said component 25 that is meant to be inserted through the annular body 27 so as to slip the hosiery item 3 off the second component 25, as will become apparent hereinafter.

Operation of the device for turning hosiery items inside out according to the invention is as follows.

The flattened hosiery item 3 is fed to the device 1, orientating its top 3*a* in the advancement direction 4 and placing said top 3*a* between the pulleys 14*a*, 14*b* and 20*a*, 20*b* so that the belts 13*a*, 13*b* and 19*a*, 19*b* engage the two opposite sides of the flattened hosiery item, moving it along the advancement direction 4. During the advancement of the hosiery item 3 along the direction 4, the belts 13*a* and 13*b* and the belts 19*a* and 19*b*, due to their gradual mutual approach along the first part 17 of their path, clamp the hosiery item on its two opposite sides, and the hosiery item is retained along a median line between the belts 13*a* and 13*b* on one side and between the belts 19*a* and 19*b* on the other side.

Then, while the belts 13*a* and 13*b* and the belts 19*a* and 19*b* continue to clamp the two opposite sides of the hosiery item, said hosiery item 3 is subjected to the action of the belts 6*a*, 6*b* and 10*a*, 10*b*, which engage the two sides of the hosiery item proximate to its longitudinal edges, continuing to advance along the direction 4. At the exit from the pulleys 15*a*, 15*b* and 21*a*, 21*b*, due to the spacing of the second part 18 of the path followed by the belts from the plane of arrangement 9, the top 3*a* of the hosiery item is opened; as it continues to advance along the direction 4, it internally receives the first component 24, preferably with the annular body 27 co-planar to the two mutually close rods 26*a* and 26*b*.

Figure 9:
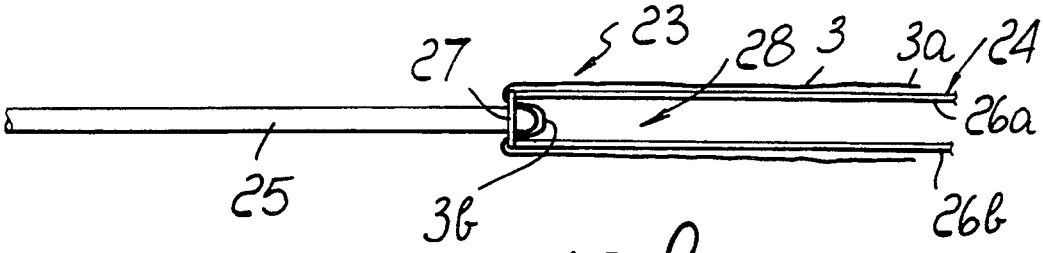
FIGS. 9 and 10 are schematic axial sectional views of the method for turning the hosiery item inside out by means of the first and second components of the reversing means according to the invention.
Figure 10:
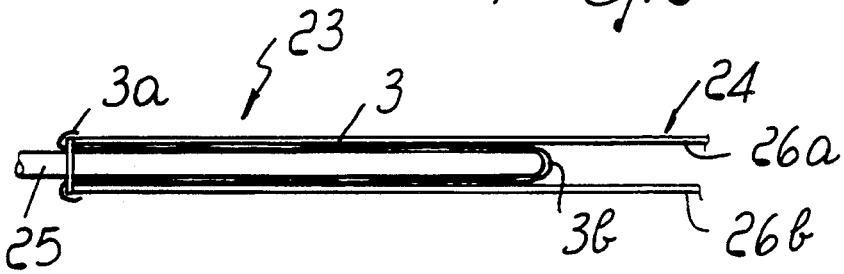
Figure 3:
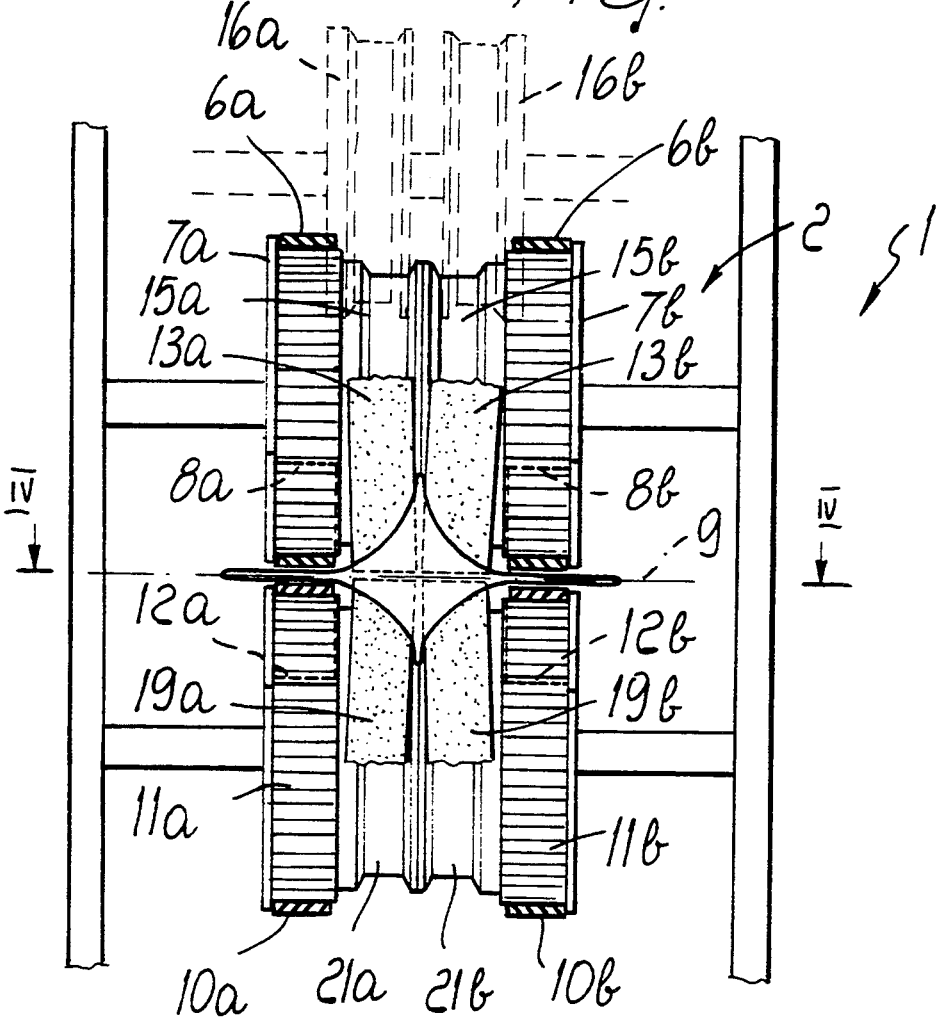
FIG. 3 is a schematic sectional view of FIG. 2, taken along the axis III—III.
Figure 4:
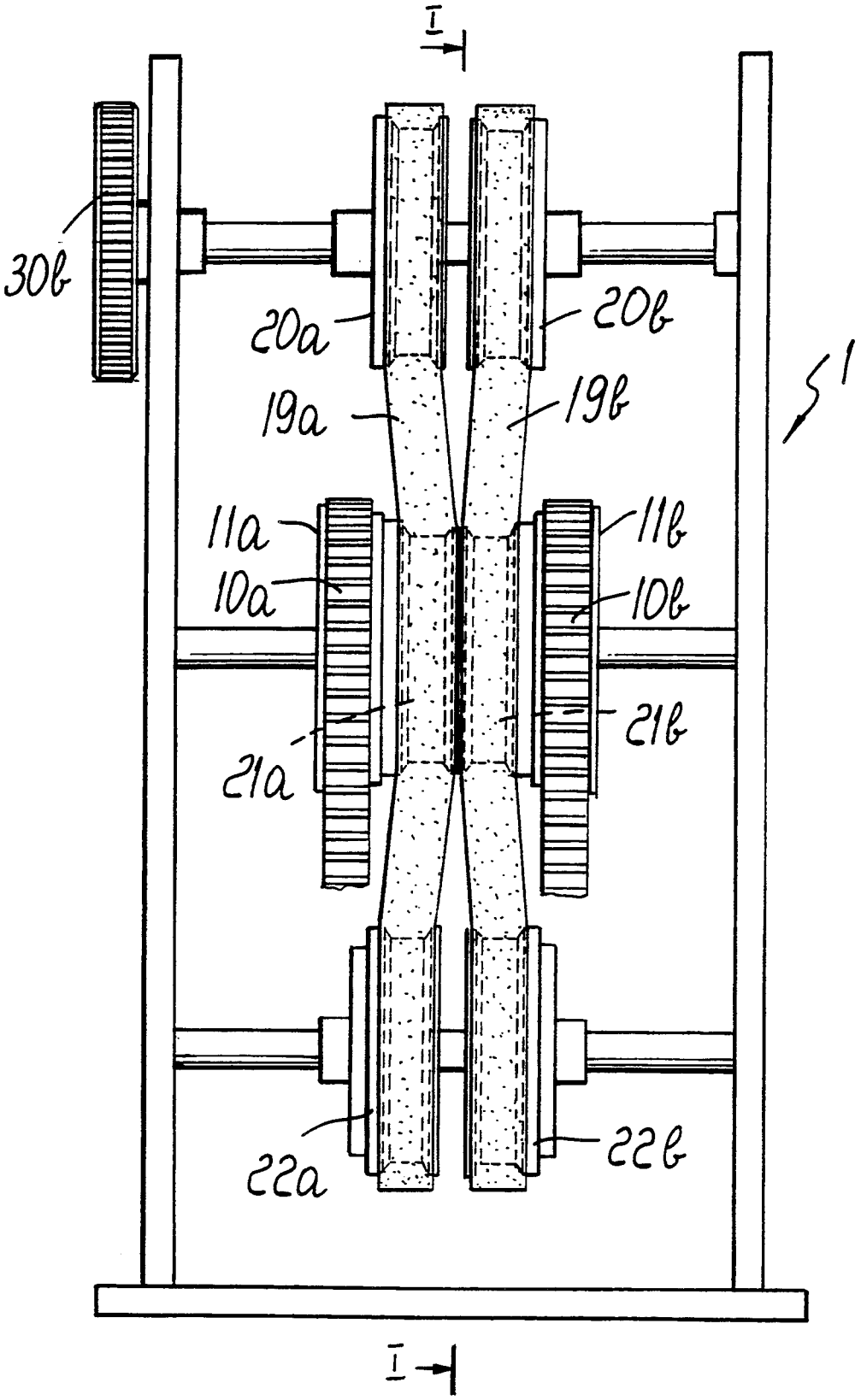
FIG. 4 is a schematic sectional view of FIG. 3, taken along the axis IV—IV, in which the hosiery item has been removed.
Figure 5:
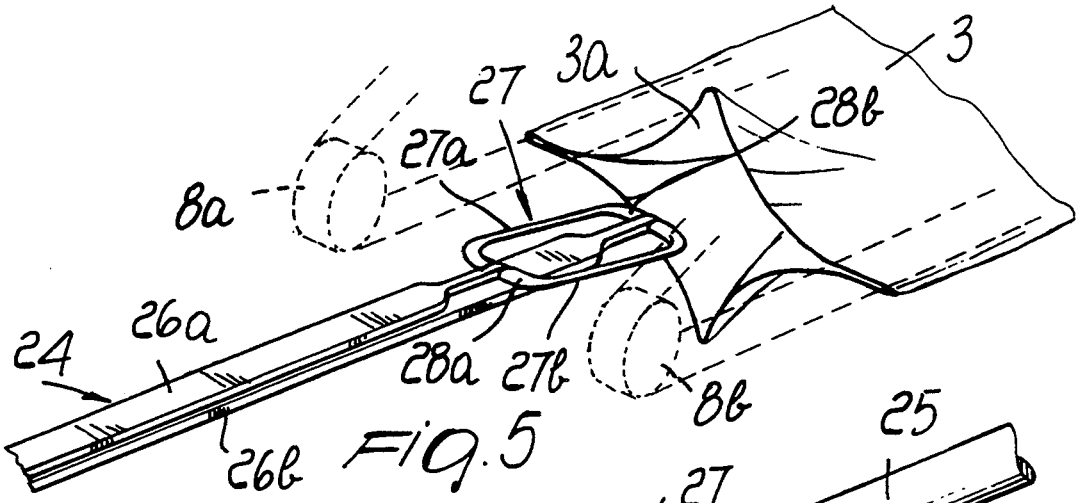
FIG. 5 is a perspective view showing the insertion of the first component of the reversing means in an operating condition that corresponds to FIG. 3.
Figure 6:
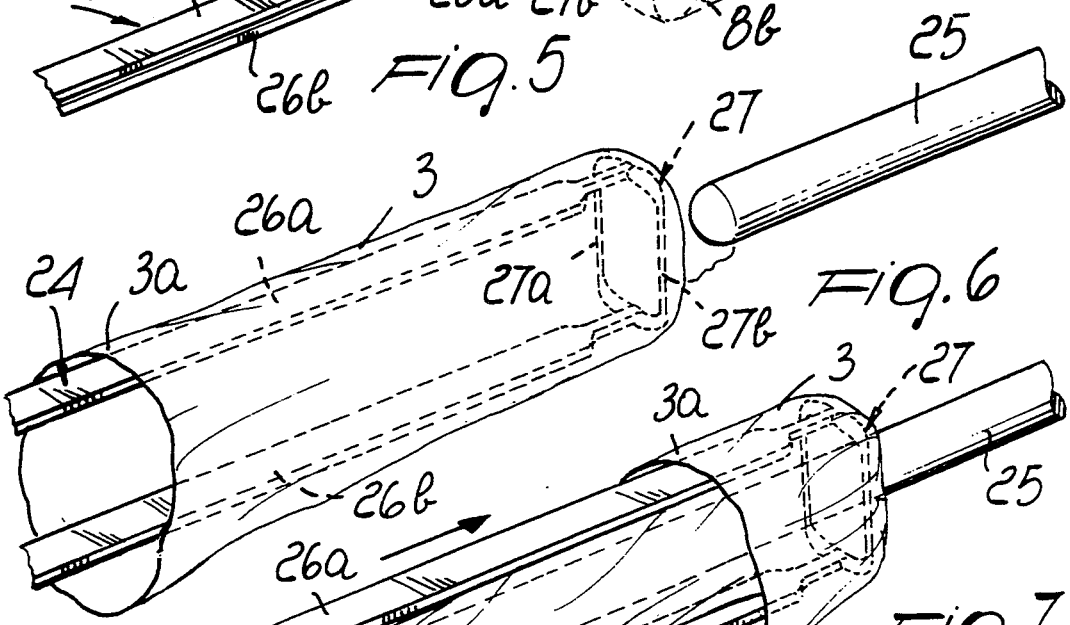
FIGS. 6 to 8 are schematic perspective views illustrating the process for turning a hosiery item inside out, performed by the first and second components of the reversing means according to the invention.
Figure 7:
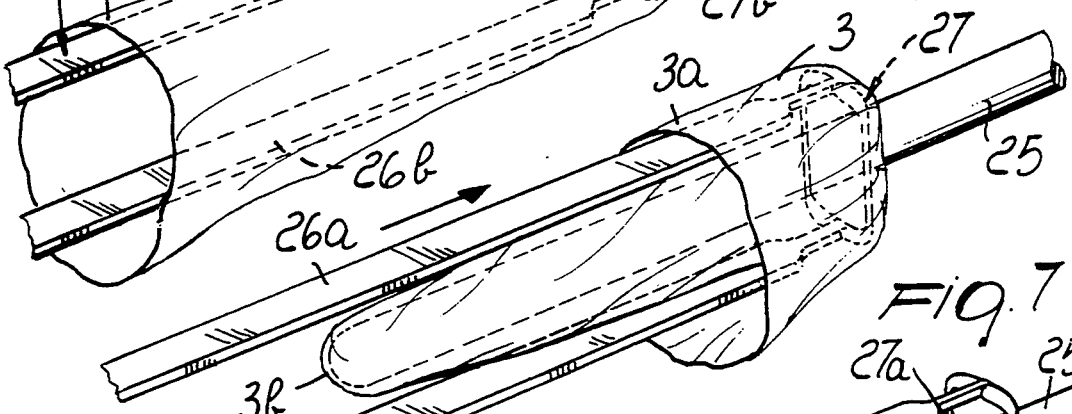
Figure 8:
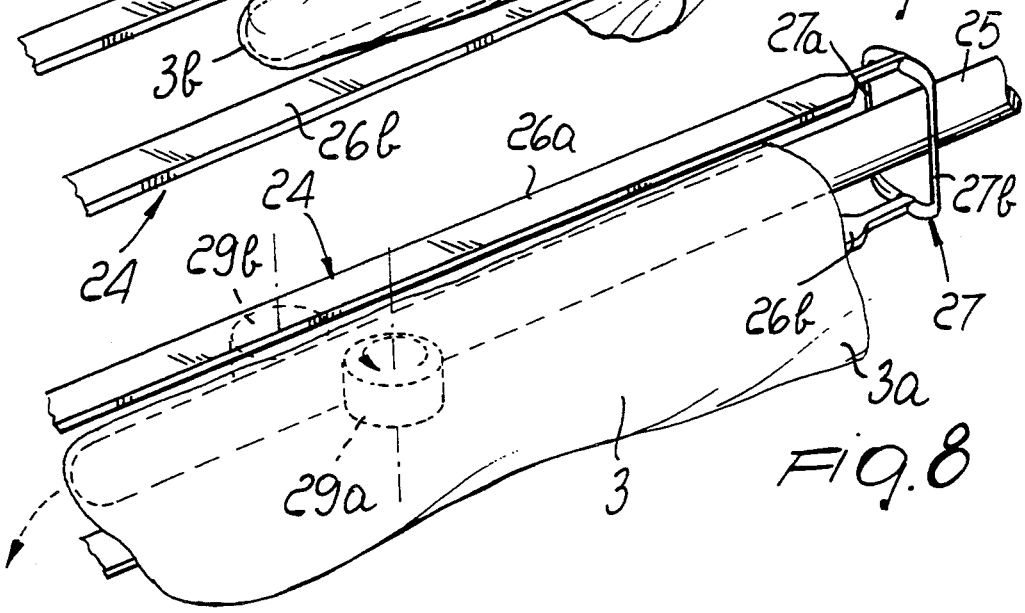

After the hosiery item 3 has been fitted completely on the first component 24, so that the toe 3*b* of the hosiery item is arranged proximate to the annular body 27, the rods 26*a* and 26*b* are moved longitudinally with respect to one another, so as to move the annular body 27 onto a plane substantially at right angles to the rods 26*a* and 26*b*, which are consequently spaced parallel to one another. At this point the end of the second component 25 is inserted in the first component 24 through the annular body 27 so as to turn the hosiery item 3 fully inside out, as shown in FIGS. 7, 9 and 10.

When the item has been turned fully inside out, the rollers 29*a* and 29*b* are laterally engaged, on opposite sides, with the hosiery item which is inside-out on the second component 25, so as to disengage said hosiery item from the second component 25, which is subsequently extracted from the first component 24.

The first component 24 is then placed again between the belts 13*a*, 13*b* and 19*a*, 19*b* where they leave the pulleys 15*a*, 15*b* and 21*a*, 21*b* so as to receive a new hosiery item 3 to be turned inside out, and the cycle starts over.

In practice it has been observed that the device for turning hosiery items inside out according to the invention fully achieves the intended aim since, by opening the top of the hosiery item beforehand, it ensures the correct insertion of the first component inside the hosiery item and thus ensures that the hosiery item is turned inside out correctly regardless of its dimensions.

Furthermore, since the item is not turned inside out by sliding with friction on the hosiery item, high safety is achieved against the possibility of damaging the hosiery item while it is being turned inside out.

The device thus conceived is susceptible to numerous modifications and variations, all of which are within the scope of the inventive concept; all the details may furthermore be replaced with other technically equivalent elements.

In practice, the materials employed, as well as the dimensions, may be any according to the requirements and the state of the art.

I claim:

1. Device for turning hosiery items inside out, wherein it comprises: means for gripping a hosiery item and moving it along an advancement direction so that the top of the hosiery item is orientated in the advancement direction; opening means that engage the hosiery item and act transversely to said advancement direction to open said top; means for turning the hosiery item inside out that comprise a first component that can be inserted in the hosiery item with one of its ends through said open top until it reaches proximate to the toe and forms, starting from said end, a cavity for the insertion of a second rod-like component which can engage the toe of the hosiery item arranged at said end of the first component and can be inserted in said first component through said end in the direction opposite to the direction of insertion of said first component in the hosiery item, turning said hosiery item inside out along said second component; and means for removing the inside-out hosiery item from said second component.

2. Device according to claim 1, wherein at least the end of said first component that is meant to be inserted in the top of the hosiery item has a substantially annular shape.

3. Device according to claim 1, wherein said grip and advancement means comprise at least two pairs of belts: a first pair of belts with portions that are arranged substantially parallel to said advancement direction and are spaced from one another, so as to make contact with one side of the flattened hosiery item, and a second pair of belts which is arranged symmetrically to said first pair of belts with respect to the plane of arrangement of the flattened hosiery item, so that their portions which are parallel to the portions of said first pair of belts make contact with the other side of the flattened hosiery item, and in that said belt portions can be driven with a translatory motion in a same direction for moving the hosiery item along said advancement direction.

4. Device according to claim 1, wherein said opening means comprise grip means that can engage the two opposite sides of the flattened hosiery item and can move away, in opposite directions, from the plane of arrangement of the flattened hosiery item in order to open the top of said hosiery item.

5. Device according to claim 1, wherein said opening means comprise at least two pairs of belts: a first pair of belts, in which a portion extends along a path with a first part that is arranged between the portions of the belts that constitute said grip and advancement means and is substantially co-planar to the plane of arrangement of the flattened hosiery item, and a second part that is arranged downstream of said first part along the hosiery item advancement direction and moves progressively away from said plane of arrangement of the flattened hosiery item, the portions of the two belts that constitute said first pair of belts of the opening means being arranged side by side and moving gradually toward each other in the hosiery item advancement direction along said first part in order to clamp one side of the flattened hosiery item between said belts and to gradually move apart, beyond a first segment of said second part, to disengage from the hosiery item after opening said top; and a second pair of belts which is arranged substantially symmetrically to said first pair of belts with respect to the plane of arrangement of the flattened hosiery item for simultaneous action on both sides of said flattened hosiery item.

6. Device according to claim 5, wherein said first component comprises a pair of mutually parallel rods, one end of which is associated with two diametrically opposite segments of an annular body that can be inserted through the open top of the hosiery item and arranged between the portions of the belts of said opening means proximate to said second part of the path followed by said belts for the automatic insertion of said annular body in the hosiery item starting from the top thereof.

7. Device according to claim 6, wherein one of the ends of said rods of said pair of rods is pivoted to said two diametrically opposite segments of the annular body, said two rods being controllably movable in a longitudinal direction with respect to one another to move said annular body from an arrangement which is substantially co-planar to said two rods, which are close to each other, to an arrangement on a plane that is substantially at right angles to said two rods, which are mutually spaced, or vice versa.

8. Device according to claim 6, wherein said annular body has a substantially elliptical shape with two diametrically opposite and mutually parallel straight portions joined by two curved segments, the ends of said two rods being pivoted to said two curved segments about pivoting axes which are substantially perpendicular to said two rods.

* * * * *